US006616357B2

(12) United States Patent
Ozawa

(10) Patent No.: US 6,616,357 B2
(45) Date of Patent: Sep. 9, 2003

(54) DOT LINE PRINTER

(75) Inventor: Hideaki Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/852,692

(22) Filed: May 11, 2001

(65) Prior Publication Data

US 2001/0043829 A1 Nov. 22, 2001

(30) Foreign Application Priority Data

May 17, 2000 (JP) ..... 2000-144986

(51) Int. Cl.[7] ..... B41J 1/50
(52) U.S. Cl. ..... 400/149; 400/139; 101/93.04
(58) Field of Search ..... 400/149, 139; 101/93.04–93.09

(56) References Cited

U.S. PATENT DOCUMENTS 3,866,533 A * 2/1975 Gilbert et al. ..... 101/93.03
4,027,761 A * 6/1977 Quaif ..... 101/93.03
4,440,079 A * 4/1984 Dayger et al. ..... 101/93.03
4,844,634 A * 7/1989 Tatsumi ..... 101/93.04

FOREIGN PATENT DOCUMENTS

JP 05185658 A * 7/1993 ..... B41J/2/51

* cited by examiner

*Primary Examiner*—Andrew H. Hirshfeld
*Assistant Examiner*—Minh Chau
(74) *Attorney, Agent, or Firm*—McGinn & Gibb, PLLC

(57) ABSTRACT

A dot line printer having printing heads of uniform characteristics, and reducing the steps number of adjustment for uniform printing quality. A dot line printer having a printing head assembly includes a plurality of spring-charged type printing heads which are linearly arrayed. The printer comprises a plurality of impact pulse generators for generating impact pulses to be applied to said printing heads; and a plurality of drive circuits, each of which is electrically connected to corresponding said impact pulse generator and to corresponding group of divided printing heads for controlling the driving of the printing heads in response to the impact pulses generated in said impact pulse generators.

15 Claims, 3 Drawing Sheets

DOT LINE PRINTER

FIELD OF THE INVENTION

The present invention relates to a dot line printer and in particular to a spring-charged type dot line printer having a printing heat assembly in which a plurality of printing heads are linearly arrayed.

BACKGROUND OF THE INVENTION

In a prior art dot line printer having a printing head assembly in which a plurality of spring-charged type printing heads are linearly arrayed, there is provided a single impact pulse generator which generates single type of impact pulse as a printing pulse. Conventionally, the single impact pulse generator is connected to all of printing heads.

SUMMARY OF THE DISCLOSURE

However, a problem occurs that the printing density and response frequency in the center of printing heads in the printing head assembly is different from those in the vicinity of the opposite ends of the assembly since the printing characteristics in the former is different from that in the latter due to the fact that the pulse widths of the impact pulses are identical.

In order to overcome the afore-mentioned problem, the characteristics of the printing heads has been made uniform by providing magnetic members which change the magnetic circuit structures in the vicinity of opposite ends or by adjusting the printing springs. There is a problem in that the number of steps for adjusting the printing quality uniform is large.

It is an object of the present invention to provide a dot line printer which is capable of making the characteristics of the printing heads uniform and of remarkably reducing the number of steps of adjustment for the uniform printing quality.

In a first aspect of the present invention, there is provided a dot line printer having a printing head assembly including a plurality of printing heads which are linearly arrayed, is wherein said dot line printer comprises a plurality of impact pulse generators for generating impact pulses to be applied to said printing heads; and a plurality of drive circuits, each of which is electrically connected to corresponding said impact pulse generator and to corresponding group of divided printing heads for controlling the driving of the printing heads in response to the impact pulses generated in said impact pulse generators.

In a second aspect of the present invention, each of said drive circuits is electrically connected to a pair of two groups among grouped printing heads, the two groups being equally spaced from a central head in the printing head assembly on the both sides thereof.

In a third aspect of the present invention, the dot printer comprises two impact pulse generators and two drive circuits, the drive circuit corresponding to one of the impact pulse generator is electrically connected to one pair of two groups of printing heads which are in the vicinity of the opposite side ends of said printing head assembly, and the drive circuit corresponding to the other impact pulse generator is electrically connected to a group of the rest of the printing heads disposed in the middle position of said printing head assembly.

In the dot line printer, it is preferred that the impact pulse generated by said impact pulse generator is preset so that it has a different pulse width for different impact pulse generator.

In the dot line printer, it is preferred that the impact pulse is applied to the printing heads disposed in the vicinity of the opposite side ends of the printing head assembly has a pulse width which is shorter than that applied to the rest of the printing heads.

PREFERRED EMBODIMENTS OF THE INVENTION

It is possible to perform the adjustment to make the characteristics of the printing heads uniform.

[Embodiments]

Figure 1:
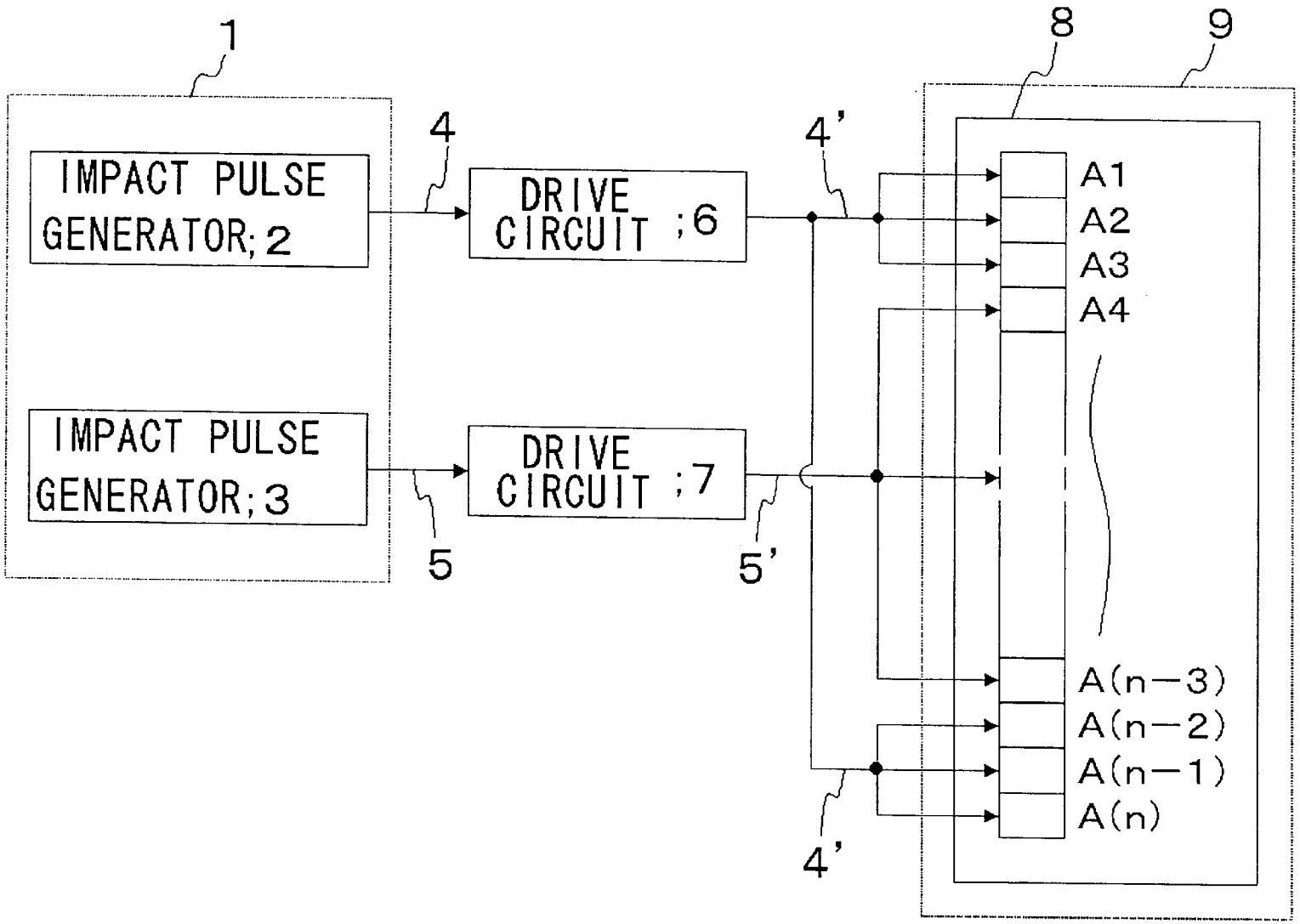
FIG. 1 is a block diagram showing the flow of pulses in the dot line printer of the embodiment 1 of the present invention.

Embodiments of the present invention will be described with reference to the drawings. FIG. 1 is a block diagram showing the flow of pulses in the dot line printer in accordance with a first embodiment of the present invention.

A printing mechanism 9 of the dot line printer has a printing head assembly 8 comprising a plurality of spring-charged printing heads A1 to An which are linearly arrayed. Impact pulse generators 2 and 3 which are part of a control circuit 1 are adapted to generate impact pulses 4 and 5, respectively to be applied to the printing heads in response to the signals from a computer and the like. A drive circuit 6 is electrically connected to the impact pulse generator 2 and is also connected to the printing heads A1 to A3 and A(n-2) to A(n) so that it controls the driving of the printing heads A1 to A3 and A(n-2) to A(n) in response to the impact pulse 4. Another drive circuit 7 is electrically connected to the impact pulse generator 3 and is also connected to the printing heads A4 to A(n-3) so that it controls the driving of the printing heads A4 to A(n-3) in response to the impact pulse 5.

The printing heads perform printing operation in response to impact pulses so that dots are formed on a paper. In accordance with the present invention the pulse widths of the impact pulses are changed along the linear array of the printing heads. In other words, printing characteristics such as printing density and response frequency are changed by changing the period of time in which the voltage is applied to the printing heads. To this end, two types of impact pulses 4 and 5 having different pulse (voltage) durations are applied from the impact pulse generators 2 and 3 via the drive circuits 6 and 7 to the printing heads in the vicinity of the opposite ends and the middle position, respectively so that the variations in the printing characteristics among the heads of the printing head assembly are eliminated (corrected or adjusted). Thus, the variations in the characteristics among the printing heads are corrected or adjusted so that uniform printing quality can be assured throughout the printing head assembly.

Figure 2:
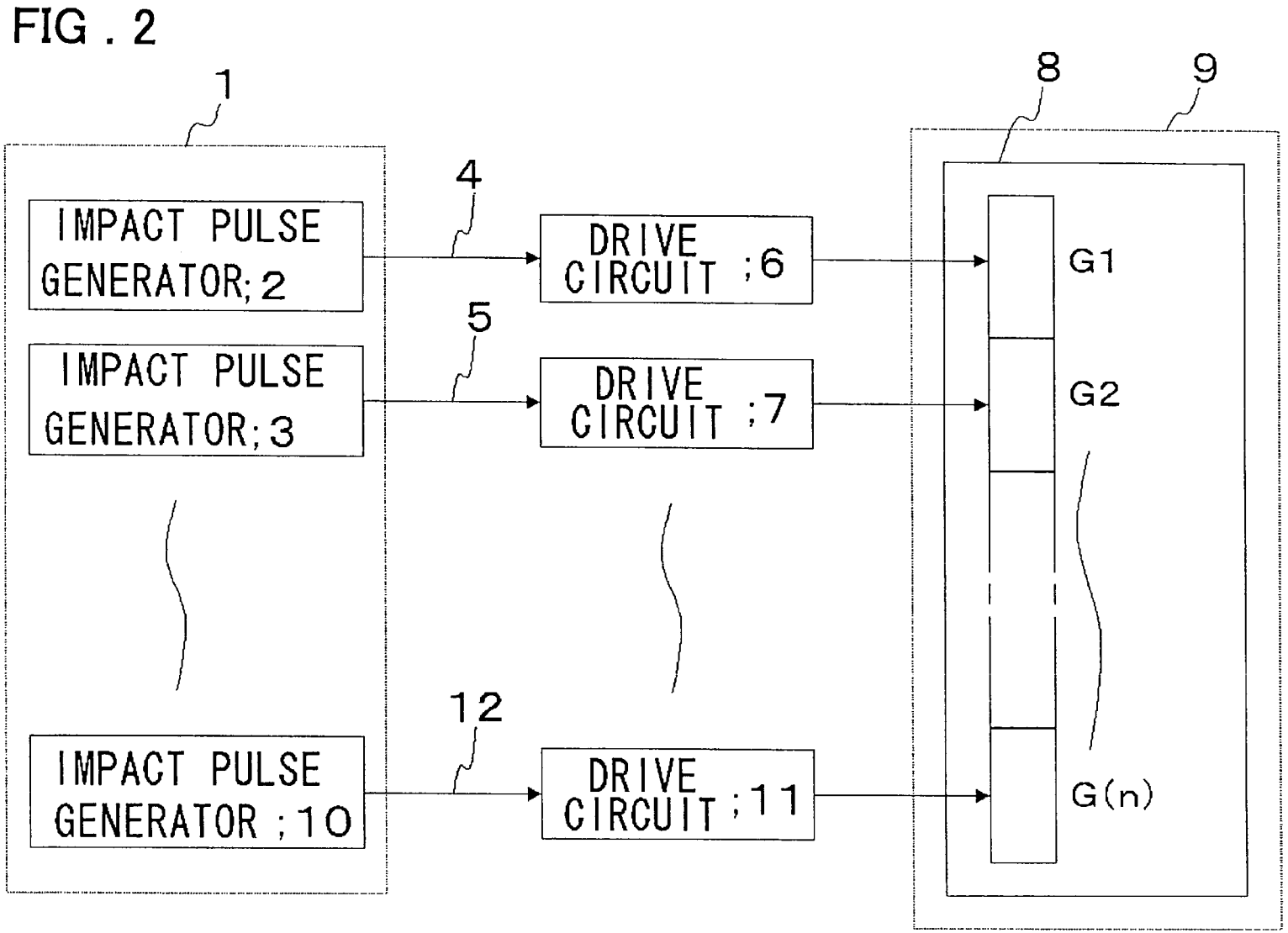
FIG. 2 is a block diagram showing the flow of pulses in the dot line printer of the embodiment 2 of the present invention.

In an alternative embodiment, the dot line printer may comprise more than 2 impact pulse generators and corresponding drive circuits. For example, as shown in FIG. 2, each of drive circuits (6, 7, . . . 11) is electrically connected to respective group (G1, G2, . . . , G(n)) of the divided (sectioned) printing heads. This makes it possible to correct or adjust the variations in characteristics among printing heads more precisely so that uniform printing quality can be obtained throughout the entire of the printing head assembly.

Figure 3:
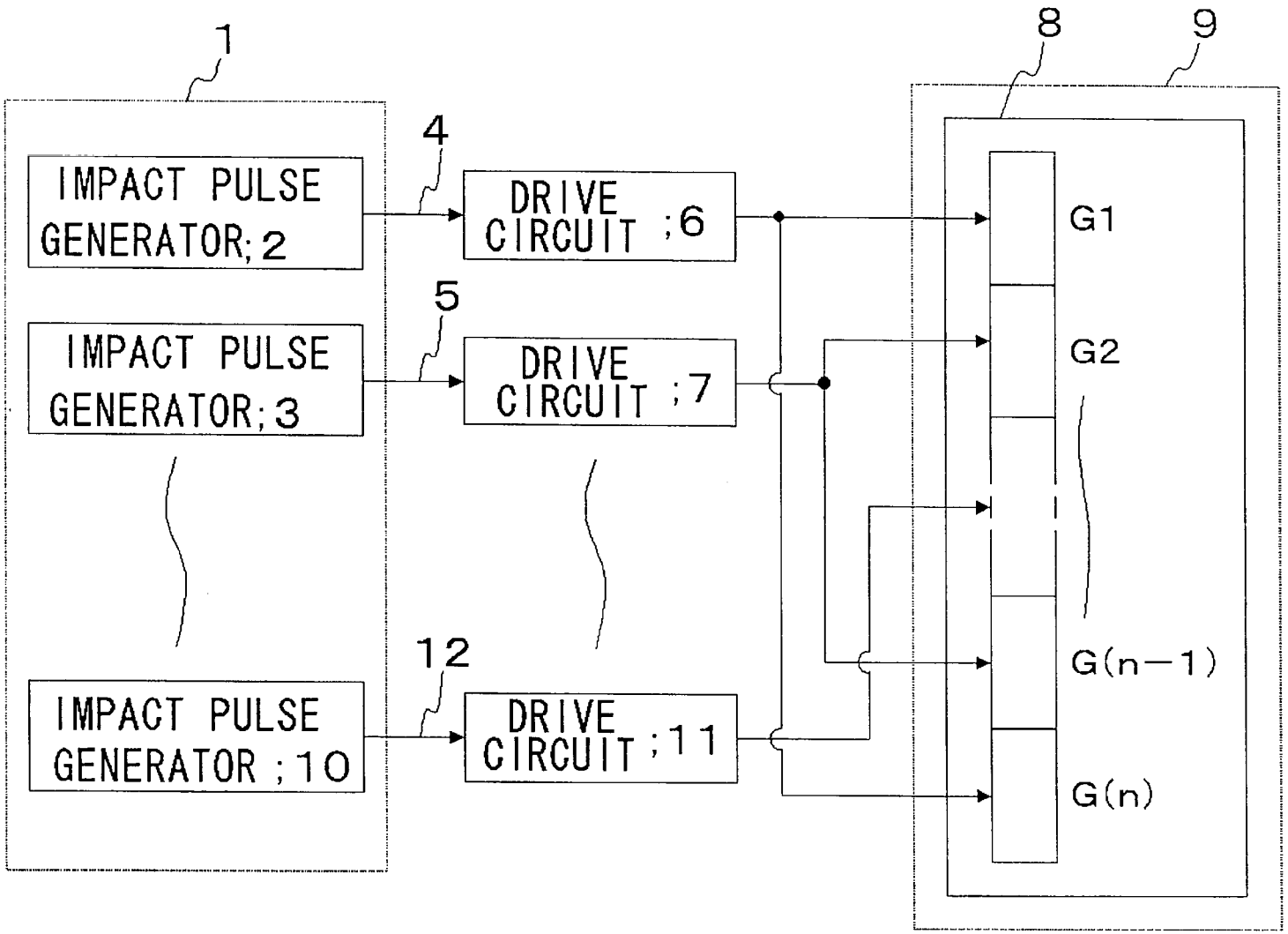
FIG. 3 is a block diagram showing the flow of pulses in the dot line printer of the embodiment 3 of the present invention.

As shown in FIG. 3, each of the drive circuit (6, 7 . . . 11) may be electrically connected to a pair of two groups (G1 and G(n), G2 and G(n-1), . . . ) which are equally spaced from the center head. This reduces the number of impact pulse generating units and drive circuits in comparison with the above-mentioned embodiment in which each of the drive circuits is electrically connected to corresponding group of the divided heads and remarkably reduces the number of steps of adjustment to make the printing quality uniform.

The meritorious effects of the present invention are summarized as follows.

Since the variations in characteristics depending upon the printing head position in the printing head assembly can be reduced in accordance with the present invention, uniform printing quality can be obtained and the necessity of magnetic members for changing the magnetic circuit structure can be eliminated and the number of the steps for adjustment to make the printing quality uniform is remarkably reduced.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A dot line printer having a printing head assembly including a plurality of printing heads which are linearly arrayed wherein said dot line printer comprises:

a plurality of impact pulse generators for generating imp act pulses to be applied to said printing heads; and a plurality of drive circuits, each of which is electrically connected to a corresponding one of said impact pulse generator and to a corresponding group of consecutively divided printing heads for controlling the driving of the printing beads in response to the impact pulses generated in said impact pulse generators.

2. The dot line printer as defined in claim 1 wherein each of said drive circuits is electrically connected to a pair of two groups among the divided printing heads, said two groups being equally spaced from a central head in said printing head assembly on both sides thereof.

3. The dot line printer as defined in claim 1 wherein said dot line printer comprises two impact pulse generators and two drive circuits, wherein said drive circuit corresponding to one of said impact pulse generators is electrically connected to one pair of two groups of printing heads which are in the vicinity of the opposite side ends of said printing head assembly, and wherein said drive circuit corresponding to the other impact pulse generator is electrically connected to a group of the rest of the printing heads disposed in the middle position of said printing head assembly.

4. The dot line printer as defined in claim 1 wherein the impact pulse generated by said impact pulse generator is preset so that it has different pulse widths for different impact pulse generators.

5. The dot line printer as defined in claim 1 wherein the impact pulse applied to the printing heads disposed in the vicinity of the opposite side ends of said printing head assembly has a pulse width which is shorter than that applied to the rest of the printing heads.

6. The dot line printer as defined in claim 1, wherein the printing heads comprise spring-charged printing heads.

7. A dot line printer according to claim 1, wherein said printing heads are sequentially divided into sections.

8. A dot line printer according to claim 1, wherein a drive circuit corresponding to one of said plurality of impact pulse generators is electrically connected to one pair of two groups of printing heads which are adjacent the opposite side ends of said printing head assembly.

9. A dot line printer according to claim 1, wherein said plurality of drive circuits corresponding to said plurality of impulse generators are electrically connected to said printing heads.

10. A dot line printer according to claim 1, wherein a first drive circuit of said plurality of drive circuits is connected to printing heads A1 to A3 and A(n-2) to A(n) of said consecutively divided printing heads so that said first device circuit controls the driving of said printing heads A1 to A3 and A(n-2) to (n) in response to said impact pulses.

11. A dot line printer according to claim 10, wherein a second drive circuit of said plurality of drive circuits is connected to printing heads A4 to A(n-3) so that said second device circuit controls the driving of said printing heads A4 to A(n-3) in response to said impact pulses.

12. A dot line printer according to claim 1, wherein said impact generators generate pulses having pulse widths of different lengths based on a position of said heads from a center of said linearly arrayed printing heads.

13. The dot line printer according to claim 1, wherein each of said drive circuits is electrically connected to a pair of two groups of printing heads among the consecutively divided printing heads.

14. The dot line printer according to claim 13, wherein said two groups of printing heads are equally spaced from a central head in said printing head assembly on both sides thereof.

15. A dot line printer according to claim 1, wherein each drive circuit of said plurality of drive circuits is electrically connected to a group, G(n), of said consecutively divided printing heads, where $n \geqq 1$.

* * * * *